US005447010A

United States Patent [19]

Voigt

[11] Patent Number: 5,447,010

[45] Date of Patent: Sep. 5, 1995

[54] INFLATABLE GIFT WRAPPING APPARATUS

[76] Inventor: Matt Voigt, P.O. Box 1402, Idaho Falls, Id. 83403

[21] Appl. No.: 259,896

[22] Filed: Jun. 15, 1994

[51] Int. Cl.[6] ..... B65B 5/04; B65B 11/50; B65B 23/00; B65D 81/02

[52] U.S. Cl. ..... 53/427; 53/449; 53/469; 53/472; 206/522; 383/3

[58] Field of Search ..... 53/472, 469, 467, 449, 53/427, 403; 206/522; 383/3

[56] References Cited

U.S. PATENT DOCUMENTS

| | | | |
|---|---|---|---|
| 3,138,248 | 6/1964 | Abbott | 206/522 |
| 3,302,780 | 2/1967 | Massman et al. | 206/522 |
| 3,421,665 | 1/1969 | Paton | 206/522 X |
| 3,679,120 | 7/1972 | Rubin | 229/23 BT |
| 3,733,005 | 5/1973 | Frieder, Jr. | 206/522 X |
| 3,995,396 | 12/1976 | Spector | 47/69 |
| 4,502,519 | 3/1985 | Clements | 206/522 X |
| 4,569,082 | 2/1986 | Ainsworth et al. | 206/522 X |
| 4,872,558 | 10/1989 | Pharo | 383/3 X |
| 4,874,093 | 10/1989 | Pharo | 206/522 |
| 4,905,835 | 3/1990 | Pivert et al. | 206/522 |
| 4,918,904 | 4/1990 | Pharo | 53/472 |
| 5,065,935 | 11/1991 | Mancel | 229/40 |
| 5,100,051 | 3/1992 | Triglia et al. | 229/87.19 |
| 5,204,146 | 4/1993 | Heinze et al. | 206/522 X |
| 5,207,376 | 5/1993 | Cohen et al. | 229/186 |

FOREIGN PATENT DOCUMENTS

| | | | |
|---|---|---|---|
| 2266474 | 10/1975 | France | 206/522 |

*Primary Examiner*—Horace M. Culver
*Attorney, Agent, or Firm*—Hopkins, Roden, Crockett, Hansen & Hoopes

[57] ABSTRACT

An inflatable wrapping apparatus comprises a substantially self supporting base for placing an article to be wrapped thereon, and an inflatable wrap attachable to the base for decoratively wrapping and securing the article in place. A periphery of a first portion of the wrap is matably attachable to a periphery of the base for enabling the first portion to substantially encompass and cover the article thereon. The first portion of the wrap separates the article from a second portion of the wrap, and the second portion has a dimension greater than the first portion. Upon inflating the wrap, the first portion inflates in a direction toward the base to substantially engulf and secure the article in place, and the second portion of the wrap inflates in a direction away from the base to provide a decorative feature of the wrap. In an alternate embodiment, the inflatable wrap is coupled to the base by an adjoining edge, providing a simple, single component wrapping apparatus.

16 Claims, 4 Drawing Sheets

INFLATABLE GIFT WRAPPING APPARATUS

TECHNICAL FIELD

This invention relates in general to an apparatus and method for wrapping an article and, in particular, to an inflatable gift wrapping apparatus and method.

BACKGROUND OF THE INVENTION

The process of wrapping a gift is a commonly performed procedure whenever an act of giving occurs. As is well known, gift wrapping and giving of gifts is notably prominent during birthdays, holidays, and other specially celebrated occasions.

Traditionally, gift wrapping occurs by enclosing a gift in a thin, sheeted, decorative wrapping material. Scissors are typically used to cut the wrapping material to a fitting size, and some form of adhesive tape is generally used to seal the wrap around the gift. Additionally, ribbons, bows, balloons, and/or other ornamental items may be attached to enhance the decorative appeal.

The process of gift wrapping, however, is often more trouble and time consuming than one would prefer. First, the multiple, separate items of wrapping paper, scissors, tape, and other decorative items must be acquired in order to wrap the gift. Secondly, neatly wrapping the gift can be difficult and cumbersome, especially when an odd shaped gift is involved. Thirdly, producing a decoratively wrapped, uniquely looking gift often presents a challenge because of the widespread and common use of the traditional wrapping methods and decorative items.

Several efforts have been made in attempt to simplify the gift wrapping process and troubles associated therewith. For example, U.S. Pat. No. 5,100,051 (Triglia et al.) discloses a preformed gift wrapper dimensioned to wrap a box of a predetermined standard size. A bag like sleeve of paper in its operational shape snugly accommodates a box which is inserted into an open end of the sleeve.

In another example, U.S. Pat. No. 3,679,120 (Rubin) discloses a pre-wrapped box comprising box sections operatively attached to a decorative wrapping sheet. The box sections are folded open and together to form the package. In a similar fashion, U.S. Pat. No. 5,065,935 (Mancel) discloses a no wrap box for gift wrapping that requires no additional wrapping paper. The box has interlocking panels which fold to form the shape.

Also, U.S. Pat. No. 5,207,376 (Cohen et al.) discloses a foldable container made from a flat blank of material provided with a plurality of fold lines. Bellows type coupling members provide a variable volume container to accommodate different sized articles therein.

U.S. Pat. No. 3,995,396 (Spector) discloses an inflatable terrarium with replaceable domes. Although this invention is not designated as a gift wrapping apparatus, the terrarium is inflatable to assume a desired configuration for housing a potted plant or other article, and the dome is hermetically sealed to a disc-like base.

Finally, U.S. Pat. No. 4,874,093 (Pharo) discloses a clam-like packaging system having two inflatable bag portions overlying each other to define a pocket therebetween for compressing and retaining an article therein. The bag portions are pivotally connected together at a rearward side; overlying edge portions are heat-sealed together at opposite lateral sides; and a frontal side is open for insertion of an article therein.

Each of these prior art patents offers individual advantages over traditional gift wrapping techniques, but each likewise retains its own drawbacks. For example, most retain a plain, simple, boxy structure and appearance. Some require multiple folding steps to form the packaging to the predefined shape. Also, most don't offer a means for supporting a variable sized article within the packaging. And, finally, some undesirably restrict the size and shape of the article to be wrapped.

Although the Cohen patent supports a variable sized article, it retains the boxy structure and appearance and requires multiple folding steps to form the shape and supporting structure. Although the Spector patent offers a distinctive inflatable dome, it isn't offered as being feasible for common gift wrapping, nor does it offer any supportive capabilities for securing the item placed within the dome.

Although the Pharo patent offers a double bag system with the capability of securing an article therein by inflation of the bags, it retains the limitations and drawbacks of a traditional envelope shaped structure. Namely, due to the envelope shape, it has severe limitations with regard to the dimensions and shape of an article capable of being placed therein. Since the package is pre-sealed on all sides except for one open end, as is a traditional envelope, insertion of the article must occur through the single, open end, thus limiting the size and shape of the article to be inserted.

Similarly, since generally rectangular and co-extensive panels form each bag, the Pharo patent is self limiting relative to its own functional properties for securing an article therein. For example, the panels are not distinguishable from each other in dimension and shape for adaptively conforming to an odd sized and shaped article. Furthermore, the package is self limiting relative to its decorative shape. Namely, the decorative appeal of a common, generally rectangular, envelope shaped object leaves much to be desired.

Accordingly, objects of the present invention are to overcome the aforementioned limitations of the prior art by providing an improved gift wrapping apparatus and simplified method for wrapping and decoratively packaging a gift or other article, which includes securing the article in place regardless of its size and shape.

SUMMARY OF THE INVENTION

According to principles of the present invention in its preferred embodiment, an inflatable wrapping apparatus comprises a substantially self supporting base for placing an article to be wrapped thereon, and an inflatable wrap easily attachable to the base for decoratively wrapping and securing the article in place.

According to further principles of the present invention, a periphery of a first portion of the wrap is matably attachable to a periphery of the base for enabling the first portion to substantially encompass and cover the article thereon. The first portion separates the article from a second portion of the wrap, and the first portion is independent in dimension and shape and not co-extensive with the second portion to allow for adaptation of the wrap to fit and secure a wide variety of different sized and shaped articles. Namely, upon inflating the wrap, the first portion inflates in a direction toward the base to substantially engulf and secure the article in place, and the second portion of the wrap inflates in a direction away from the base to provide a decorative feature of the wrap of any predefined shape and size.

According to further principles of the present invention, the inflatable wrap is a separable component from the base prior to wrapping of the article in order to adaptively wrap a wide variety of differently shaped and sized articles. In an alternate embodiment, the wrap is pre-attached to the base by an adjoining edge, providing a simple, single component wrapping apparatus. In the single component embodiment, the wrap is foldable over the article and base, at the adjoining edge, and is attachably mated with the base and easily inflated to any predefined shape and size.

According to further principles of the present invention, a method for decoratively wrapping is disclosed, comprising the few and simple steps of: placing an article to be wrapped on a substantially self supporting base; placing an inflatable wrap over the article; attachably mating the wrap with the base; and, inflating the wrap to a predefined decorative shape and form.

Other objects, advantages, and capabilities of the present invention will become more apparent as the description proceeds.

DETAILED DESCRIPTION OF THE INVENTION

Figure 1:
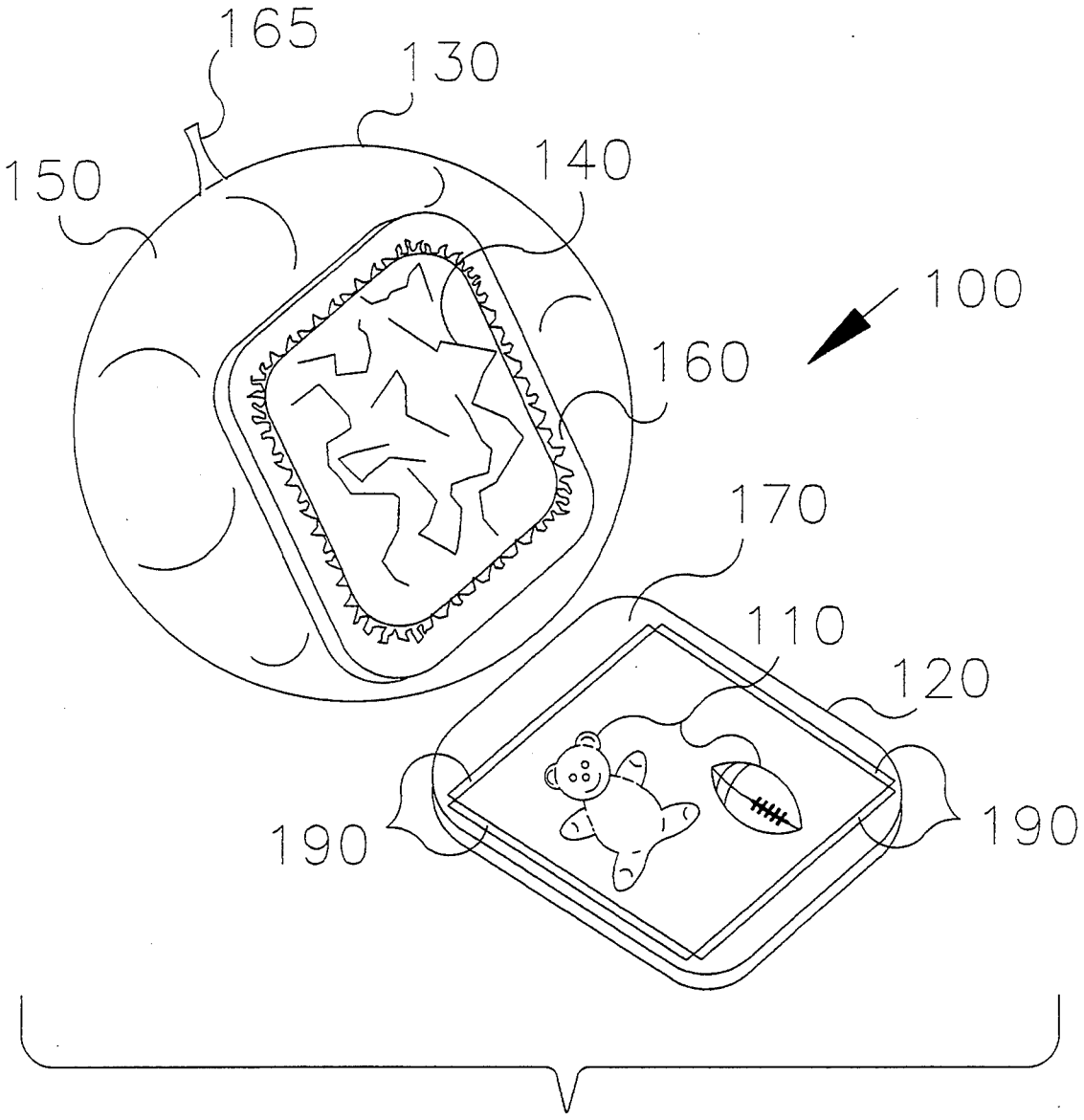
FIG. 1 is a perspective view of the present invention inflatable gift wrapping apparatus having an article placed therein and ready to be wrapped.

FIG. 1 is a perspective view of the present invention inflatable gift wrapping apparatus 100 having article 110 placed therein and ready to be wrapped. Article 110 is shown merely as representative of the multiplicity of different shaped and sized articles or gifts that are capable of being wrapped by the present invention.

In its preferred embodiment, the invention comprises substantially self supporting base 120 and inflatable wrap 130. Wrap 130 comprises first and second portions 140 and 150, respectively, and is inflatable via inflation device 165. Although not required, wrap 130 is preferably of a decorative nature.

First portion 140 includes periphery 160 which is attachably matable with periphery 170 of base 120. In its preferred embodiment, base 120 comprises a substantially self-supporting material, such as cardboard or the like, sufficiently strong to support variable sized, shaped, and weighty articles placed thereon. Likewise in its preferred embodiment, periphery 160 comprises a substantially self-supporting material so that periphery 160 attachably mates with periphery 170 of base 120 in a sturdy manner. However, in alternate embodiments, it is apparent that peripheries 160 and 170 may be constructed of more flexible materials without departing from the scope of the invention.

In its preferred embodiment, base 120 is a separate component from wrap 130 prior to wrapping of an article to allow for a wide variety of sizes and shapes of articles to be wrapped. In this fashion, the wrap is brought down directly over base 120 and article 110 to afford wrapping of an article that is substantially as large as base 120, and substantially as large as wrap 130 in its inflated state. In an alternate embodiment, base 120 is coupled to periphery 160 of first portion 140 by means of an adjoining edge to form a single component wrapping apparatus (see FIG. 4A). However, having an adjoining edge limits the size and shape of an article that is capable of being wrapped because of the folding down that must occur of the wrap over the base by being hinged at the adjoining edge. Likewise, if more than one edge were pre-sealed, the opening for insertion of an article therein is severely limited, and, consequently, the size and shape of the article capable of being wrapped. Accordingly, a preferred embodiment has no adjoining edges. However, a single adjoining edge is a feasible alternative (see FIG. 4A).

Periphery 160 is attachably matable with periphery 170 by exposing adhesive strips 190 and subsequently placing wrap 130 down over and on top of article 110 and base 120. In so doing, periphery 160 mates with and is attachably secured to periphery 170. Consequently, article 110 is secured on the base by being encompassed by the respective peripheries and first portion 140. Also in alternate embodiments, other means for attachably mating peripheries 160 and 170 are used, such as gluing or forming the peripheries so that they interlock upon mating together (see also, FIGS. 4A–B).

First and second portions of wrap 130 are constructed of gas-impervious, inflatable materials commonly used in the art which may or may not have elastic characteristics. Preferably, wrap 130 is constructed of a tough film of polyester, such as Mylar. However, first portion 140, second portion 150, and periphery 160 may be of separate, distinct materials operatively attached to form wrap 130 as a whole.

In its preferred embodiment, first and second portions 140 and 150 of wrap 130 are of a different dimension and shape with respect to each other. First portion 140 includes sufficient elastic material to be stretched, or sufficient other material to be gathered or bunched as bounded by periphery 160, such that as periphery 160 is brought down over and around article 110, mating of the respective peripheries 160 and 170 can occur without tearing first portion 140 as it covers over article 110. On the other hand, first portion 140 is not of excessive material such that article 110 is loose on base 120 after inflation of wrap 130. Furthermore, second portion 150 includes sufficient material to cover an article placed on the base after inflation. Preferably, second portion 150 comprises substantially more material than first portion 140 in order to provide decorative appeal in shape and size upon inflation thereof.

Base 120 and periphery 160 are formed of any predetermined shape and size, so long as the shape and size allows for peripheries 160 and 170 to attachably mate. However, base 120 must be sufficiently large to expose periphery 170 after article 110 is placed thereon. Wrap 130 is also formed of any predetermined shape and size so that upon inflation, the wrap fills to its predetermined form, which may be, for example, functionally decorative for the gift or occasion at hand.

Upon attaching wrap 130 to base 120, wrap 130 is ready to be inflated via inflation device 165 or some other suitable means known in the art. Upon inflating wrap 130, article 110 is secured in place by being substantially engulfed by first portion 140 being inflated in a direction toward base 120. Second portion 150 is inflated in a direction away from base 120 for decorative appeal, as more fully shown in FIG. 2.

Figure 2:
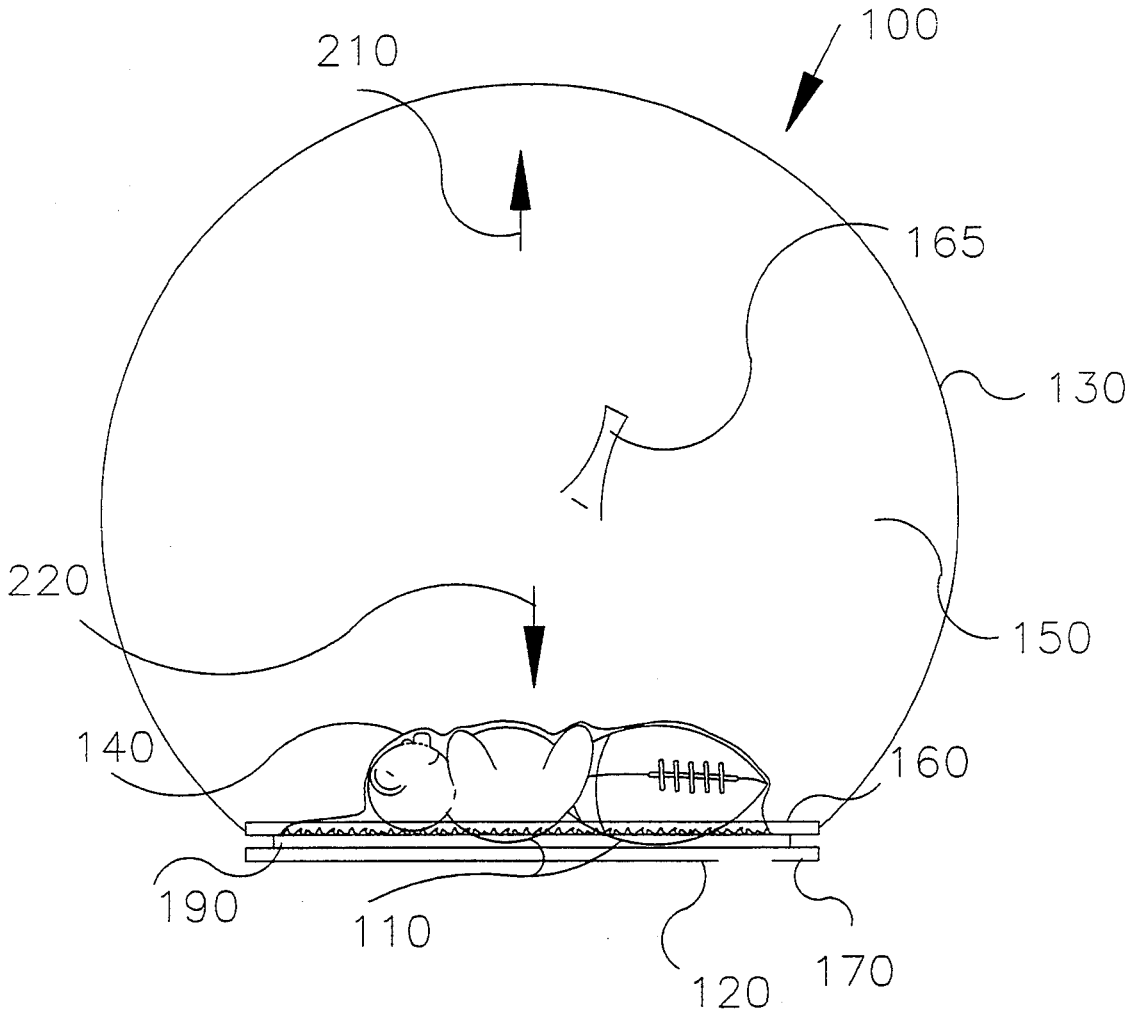
FIG. 2 depicts a cross sectional, side-elevation view of the invention having an article wrapped therein and the wrap inflated for securing the article and providing a decorative appearance.

FIG. 2 depicts a cross sectional, side-elevation view of gift wrapping apparatus 100 having article 110 wrapped therein. Wrap 130 is inflated such that second portion 150 is inflated in a direction away from base 120, depicted by directional arrow 210, and has taken the form of a balloon shape in this example. The shape and size is arbitrarily chosen in this depiction, but is representative of any number of shapes and sizes usable as is well known in the art of inflatable objects. In contrast, first portion 140 is inflated in a direction toward base 120, depicted by directional arrow 220, such that it substantially engulfs article 110 and secures it in place against base 120.

As clearly detailed in the diagram, first portion 140 is not co-extensive in size and/or shape with second portion 150. Namely, second portion 150 comprises a substantially larger surface area of material so that upon inflation thereof it creates a distinctive, decorative appeal, separate in size and shape from first portion 140. In contrast, first portion 140 in its inflated state attempts to conform to the shape of article 110 to secure it in place against base 120.

Periphery 160 of first portion 140 is depicted as being securely mated to periphery 170 of base 120 by adhesive strips 190.

Figure 3:
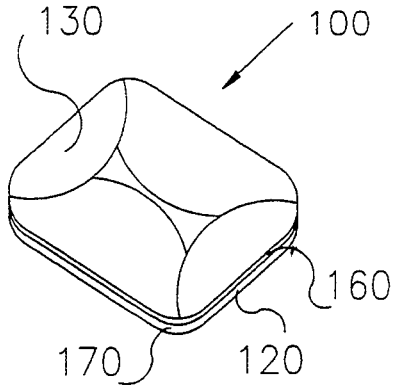
FIG. 3 is a perspective view of the invention in a folded up position for ease of handling before wrapping and inflation thereof.

FIG. 3 is a perspective view of gift wrapping apparatus 100 in a folded up position for ease of handling before wrapping and inflation thereof. Wrap 130 is in a deflated state, and any material that may normally extend beyond base 120 in a non-constrained position is folded in and on top of wrap 130 and base 120. Periphery 170 of base 120 is placed adjacent periphery 160 of first portion 140, but they are not matably attached because adhesive strips 190 (see FIG. 1) have not been exposed. This folded up position reduces the size of the invention and simplifies the packaging requirements for shipping, handling and the like.

Figure 4A:
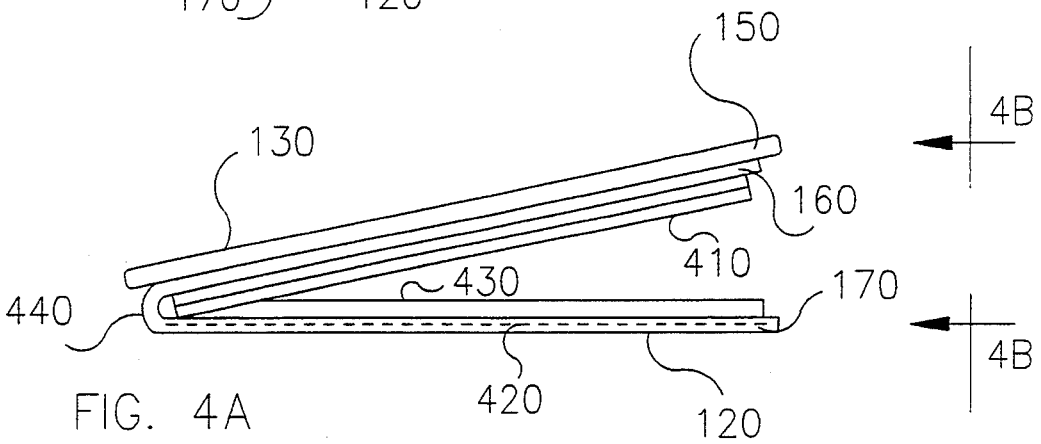
FIG. 4A depicts a side-elevation view of an alternate embodiment for attachably mating the wrap with the base.

FIG. 4A depicts a side-elevation view of an alternate embodiment for attachably mating wrap 130 with base 120. Wrap 130 is foldably attached at adjoining edge 440 with base 120 to provide a single component wrapping apparatus.

Also, as an alternate to using an adhesive, FIG. 4A depicts an interlockable tongue and groove embodiment wherein tongue 410 is formed upon periphery 160 of wrap 130, and groove 420 is formed within periphery 170 of base 120. To interlock the wrap and base components together and to secure an article therein, tongue 410 is inserted into groove 420. Tongue 410 pops into groove 420 with sufficient applied force, and remains interlocked until sufficient counter-applied force breaks the hold. Lip 430 extends adjacent periphery 170 along at least two substantially opposing sides of the base. The lip serves to provide more support for holding the article in place; provide rigidity to the base; and guidance for attachably mating the peripheries.

Figure 4B:
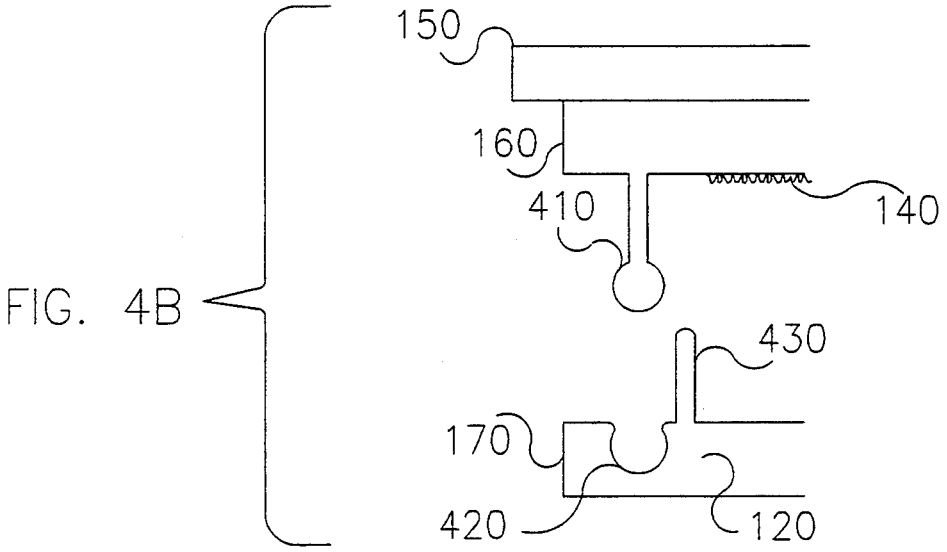
FIG. 4B depicts a partial front-elevation view taken along lines 4B—4B of FIG. 4A.

FIG. 4B depicts a detailed, partial, front-elevation view of a feasible tongue and groove embodiment taken along lines 4B—4B of FIG. 4A. Tongue 410 projects from periphery 160 for interlockably mating with groove 420 embedded in periphery 170 of base 120. As shown, lip 430 helps guide tongue 410 down into groove 420. Although not shown, other methods known in the art of attachably mating the wrap with the base would also suffice.

Figure 5:
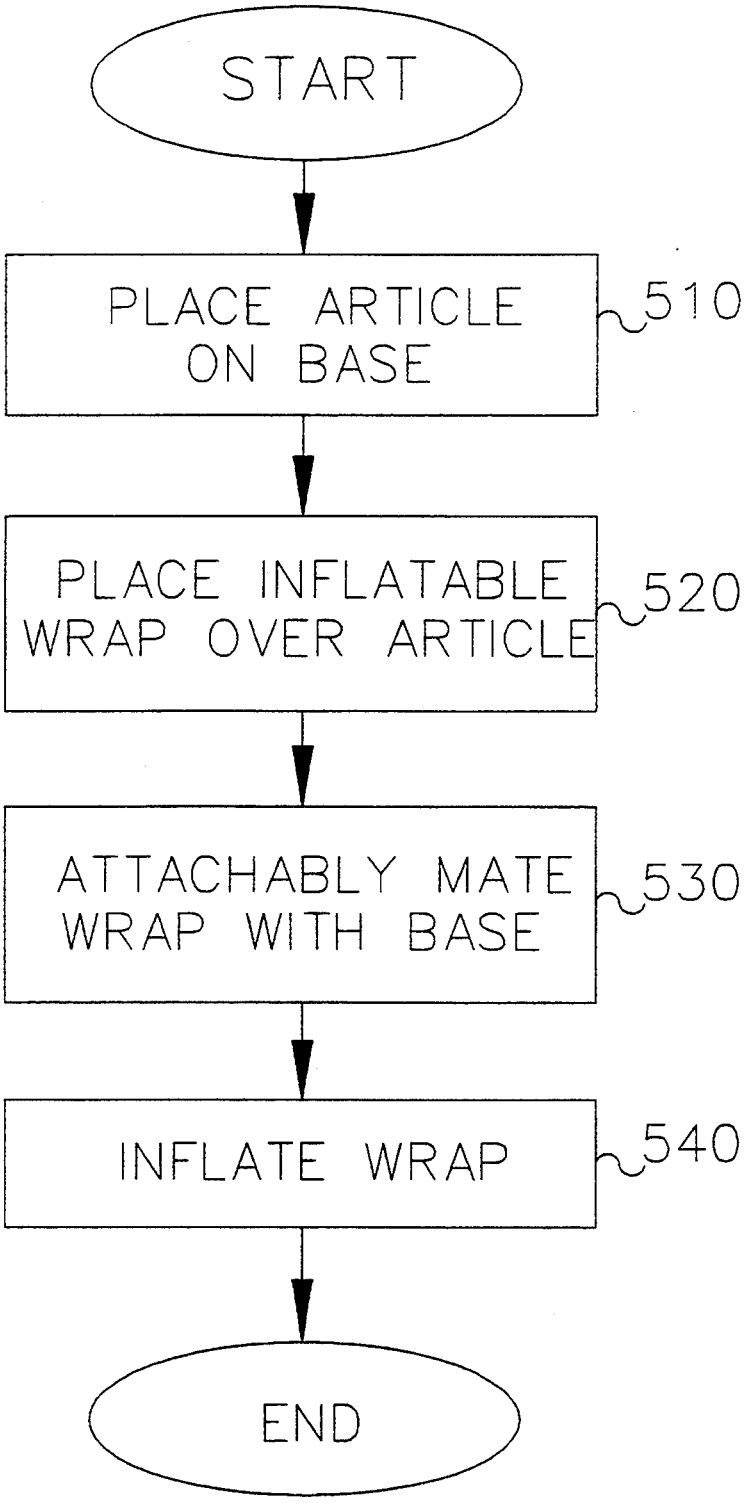
FIG. 5 is a flow chart diagraming the few and simple steps required for wrapping an article as disclosed by the invention.

FIG. 5 is a flow chart diagram of the few and simple steps required for wrapping an article as disclosed by the invention. First, an article to be wrapped is placed upon a base, 510 (see also, FIG. 1). The article must be placed on the base such that a periphery of the base remains exposed after the article is placed thereon. Second, an inflatable wrap is placed over the article, 520 (see also, FIGS. 1 and 2). Third, the wrap is attachably mated with the base by adhering or interlocking the exposed periphery of the base with a periphery of a first portion of the wrap, 530 (see also, FIGS. 1, 2, and 4A–B). Fourth, the wrap is inflated wherein a first portion of the wrap inflates in a direction toward the base for substantially engulfing and securing the article in place, and a second portion of the wrap inflates in a direction away from the base for providing decorative appeal (see also, FIG. 2).

What has been described above are the preferred embodiments for a novel, inflatable gift wrapping apparatus and method. It is clear that the present invention provides a unique and simple tool for decoratively wrapping articles for any occasion. While the present invention has been described by reference to specific embodiments, it will be apparent that other alternative embodiments and methods of implementation or modification may be employed without departing from the true spirit and scope of the invention.

What is claimed is:

1. A wrapping apparatus comprising:

a) an inflatable wrap having a first and second portion, the first portion having a defined periphery, and the second portion having a dimension larger than the first portion for inflation into a decorative shape;

b) a substantially self-supporting base, unattached and separate from the inflatable wrap, for placing an article to be wrapped thereon, having a periphery for attachably mating with the periphery of the first portion of the wrap, and wherein the article being placed on the base is encompassed by the respective peripheries;

c) means for attaching the periphery of the first portion to the periphery of the base; and, d) means for inflating the wrap wherein the first portion of the wrap inflates in a direction toward the base for substantially engulfing and securing the article in place, and the second portion of the wrap inflates in a direction away from the base to form a decorative shape.

2. The inflatable wrapping apparatus of claim 1 wherein the wrap includes sufficient material in each first and second portion such that it can be brought down over and around the article and attached to the base without tearing as it covers over the article.

3. The inflatable wrapping apparatus of claim 1 wherein the base is coupled to the wrap by an adjoining edge to form a single component wrapping apparatus.

4. The inflatable wrapping apparatus of claim 1 wherein the periphery of the first portion comprises a substantially self-supporting material.

5. The inflatable wrapping apparatus of claim 1 wherein the periphery of the first portion is hermetically attachable to the periphery of the base.

6. The inflatable wrapping apparatus of claim 1 wherein the periphery of the first portion is adhesively attachable to the periphery of the base.

7. The inflatable wrapping apparatus of claim 1 wherein the periphery of the first portion is interlockably attachable with the periphery of the base.

8. The inflatable wrapping apparatus of claim 1 wherein the base includes a lip protruding upward from the base substantially adjacent the periphery of the base for guiding the periphery of the base into direct operable mating relationship with the periphery of the first portion of the wrap.

9. The inflatable wrapping apparatus of claim 1 wherein the wrap is of a dimension and shape sufficient to ensure coverage of the article upon inflation of the wrap.

10. The inflatable wrapping apparatus of claim 1 wherein the base is of a size and shape sufficient to ensure exposure of the periphery of the base after the article is placed thereon for attachably mating with the wrap.

11. The inflatable wrapping apparatus of claim 1 wherein the wrap folds substantially flat on the base for ease of handling before inflation and wrapping occurs.

12. A method of wrapping an article comprising the steps of:

a) placing the article upon a base such that a periphery of the base remains exposed after the article is placed thereon;

b) placing an inflatable wrap over the article, the wrap being unattached and separate from the base prior to being placed over the article and having a first and second portion, the second portion having a dimension larger than the first portion for inflation into a decorative shape;

c) attachably mating a periphery of the first portion of the wrap with the periphery of the base; and, d) inflating the wrap wherein the first portion of the wrap inflates in a direction toward the base for substantially engulfing and securing the article in place, and the second portion of the wrap inflates in a direction away from the base to form a decorative shape.

13. The method of wrapping an article according to claim 12 further including folding the inflatable wrap over the article by means of the wrap and base being adjoined at a folding edge.

14. The method of wrapping an article according to claim 12 further including hermetically attaching the periphery of the wrap to the periphery of the base.

15. The method of wrapping an article according to claim 12 further including adhesively attaching the periphery of the wrap to the periphery of the base.

16. The method of wrapping an article according to claim 12 further including interlockingly attaching the periphery of the wrap with the periphery of the base.

* * * * *